United States Patent [19]

Müller

[11] 3,967,654

[45] July 6, 1976

[54] YARN FEED MECHANISM FOR A WEAVING MACHINE

[75] Inventor: Jakob Müller, Zwidellen, Switzerland

[73] Assignee: Jakob Muller, Forschungs-und Finanz AG, Frick, Switzerland

[22] Filed: Oct. 30, 1974

[21] Appl. No.: 519,109

[30] Foreign Application Priority Data

Nov. 27, 1973 Switzerland ..... 16646/73

[52] U.S. Cl. ..... 139/452; 226/96; 226/154; 226/171

[51] Int. Cl.[2] ..... D03D 47/34

[58] Field of Search ..... 139/122 R, 122 H, 127 P; 66/132; 226/96, 154, 171

[56] References Cited

UNITED STATES PATENTS

| | | | |
|---|---|---|---|
| 3,289,906 | 12/1966 | Schuller | 226/171 |
| 3,361,317 | 1/1968 | Levin | 66/132 |
| 3,596,683 | 8/1971 | Dendo | 139/122 |
| 3,799,212 | 3/1974 | Stanislau et al. | 139/122 |
| 3,802,616 | 4/1974 | Gabalda | 226/171 |
| 3,831,830 | 8/1974 | Venot | 226/171 |

FOREIGN PATENTS OR APPLICATIONS

| | | | |
|---|---|---|---|
| 810,305 | 3/1959 | United Kingdom | 66/132 |

*Primary Examiner*—Henry S. Jaudon
*Attorney, Agent, or Firm*—Diller, Brown, Ramik & Wight

[57] ABSTRACT

A yarn transport mechanism for a needle band weaving machine comprising a carrier which can be placed into revolving motion with variable speed, said carrier possessing a friction coating against which there can be placed the yarn which is to be conveyed for the purpose of entrainment thereof.

1 Claim, 9 Drawing Figures

YARN FEED MECHANISM FOR A WEAVING MACHINE

BACKGROUND AND SUMMARY OF THE INVENTION

The present invention relates to a new and improved construction of yarn transport mechanism at a needle band weaving machine.

It is a primary object of the present invention to provide at a needle band weaving machine the most uniform possible infeed of the yarn or the like which is to be conveyed and to be able to optionally regulate the conveyed yarn quantity depending upon requirements.

Now in order to implement this object as well as others which will become more readily apparent as the description proceeds, the inventive yarn transport mechanism for a needle band weaving machine comprises a carrier which can be placed into revolving motion with variable speed, this carrier possessing a friction coating against which there can be placed the yarn which is to be conveyed for the purpose of entrainment thereof.

Preferably the carrier which can be placed into revolving motion is constituted by an endless transport belt which travels over rollers and is equipped with the friction coating or covering.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
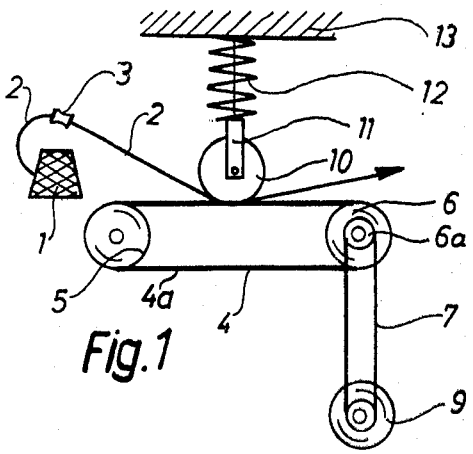
FIG. 1 is a side view of a first exemplary embodiment of a yarn transport mechanism of a needle band weaving machine.
Figure 2:
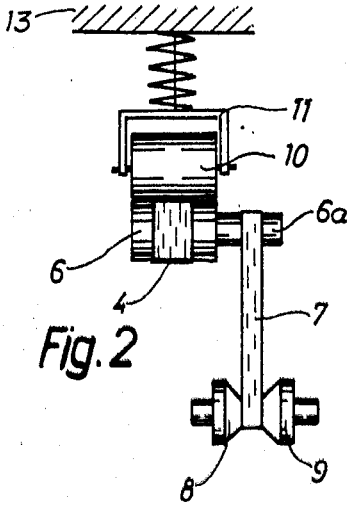
FIG. 2 is a front view of FIG. 1.

Describing now the drawings, in the exemplary embodiment depicted in FIGS. 1 and 2 there is shown a yarn or thread spool 1 from which there is drawn off, for instance, the weft or filling thread or yarn 2 for a needle band weaving machine and guided through an eyelet 3. A carrier which is here shown in the form of an endless transport belt 4 is provided with a friction coating or covering, generally designated by reference character 4*a*, and this belt travels over two rollers 5 and 6. The roller 6 carries at one end a belt pulley 6*a* over which travels a V-belt 7 which furthermore travels between two V-belt pulleys 8, 9 of which at least one is axially adjustable in order to be able to infinitely variably drive the pulley 6*a* and thus the roller 6. A contact roller 10 cooperates with the transport belt 4, this contact roller 10 being rotatably mounted upon a bracket 11. Acting upon the bracket 11 is a spring 12 which is fixedly supported at its other end at location 13. The yarn or thread 2 is guided between the contact roller or roll 10 and the transport belt 4 and owing to the action of the spring-influenced roller 10 is pressed against the belt 4 and thereby positively entrained. By adjusting the V-belt pulley 8, 9 the rotational speed of the belt 4 can be changed and thus there can be reduced or enlarged, depending upon requirements, the required yarn or thread quantity.

Figure 3:
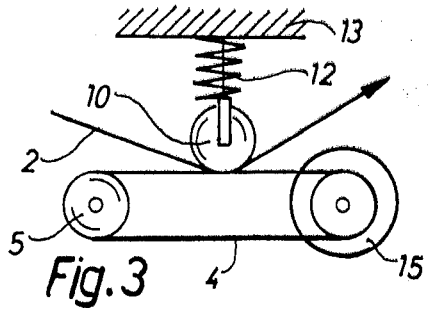
FIG. 3 is a side view, similar to the showing of FIG. 1, of a modified embodiment of transport mechanism.
Figure 4:
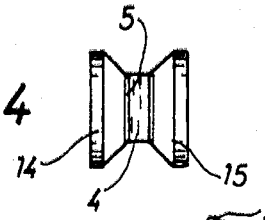
FIG. 4 is a front view of FIG. 3.

The exemplary embodiment of FIGS. 3 and 4 differs from that of FIGS. 1 and 2 only insofar as here the belt 4, instead of traveling over the roller, travels between two conical belt pulleys 14, 15 which are axially adjustable similar to the pulleys 8, 9 in order to directly drive with variable speed of rotation the transport belt 4.

Figure 5:
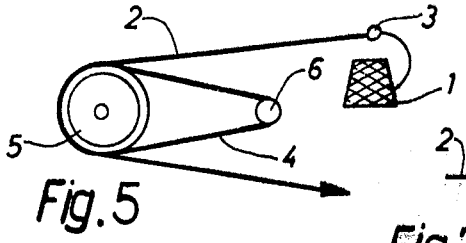
FIGS. 5–9 are respective side views of further exemplary embodiments of yarn transport mechanisms.

With the embodiment of FIG. 5 again a transport belt 4 travels over two rollers 5 and 6, wherein the one, for instance, in the same manner as the previous exemplary embodiments, is driven with variable rotational speed. The yarn 2 which is drawn off of the spool 1 and guided through the eyelet 3 in this case is placed over a portion of the revolving path of travel of the belt 4 against such belt and thus entrained in accordance with the rotational speed of the belt 4.

Figure 6:
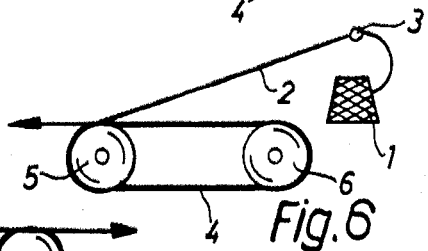

With the exemplary embodiment of FIG. 6 the yarn 2, instead of being entrained over a part of the revolving path of travel of the transport belt 4, is entrained over the entire revolving path of travel of such transport belt 4.

Figure 7:
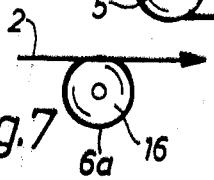

With the embodiment according to FIG. 7 there is provided a roller 16 covered with an adhesion coating or covering, generally designated by reference character 16*a*, and which roller can be driven with variable peripheral speed by means of a not particularly illustrated but conventional infinite gearing or drive. The yarn or thread 2 is placed about the entire periphery of the roller 16 and is thus positively entrained thereby.

With the exemplary embodiment depicted in FIG. 8 again an endless transport belt 4 travels over the rollers 5 and 6, of which one, for instance, similar to the embodiment of FIGS. 1 and 2, can be driven by an infinitely variable gearing or drive generally indicated by reference character 100 in FIG. 8, in order to be able to change the speed of rotation of the transport belt 4. The thread or yarn 2 in this case is pressed by means of a roller 17 against the belt 4. The roller 17 is mounted at an arm 18 of an angle lever arrangement or angle lever means 18, 19. At the other arm 19 there acts an eccentric cam 20, through the rotation of which the lever arrangement 18, 19 is rocked or piveted and thus the roller 17 is pressed against or lifted away from the belt 4. Consequently, in this instance the yarn or thread 2 can be optionally brought into and out of engagement with the belt 4 and entrained thereby.

Figure 8:
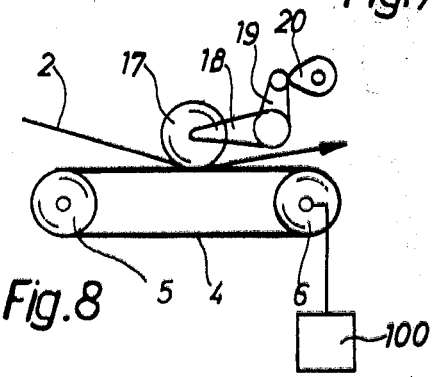
Figure 9:
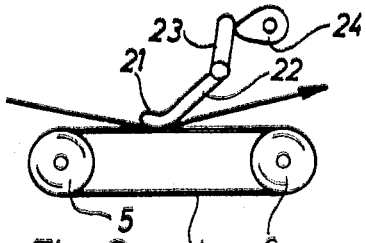

The exemplary embodiment of FIG. 9 differs from that of FIG. 8 only insofar as here, instead of the roller 17, there is provided a yarn press shoe 21 at a double-arm lever arrangement 22, 23, at which a cam 24 acts in order to selectively press the shoe or runner 21 against the belt 4 or to lift such away therefrom.

Due to the described transport mechanism it would be possible instead of the weft or filling thread which is drawn off of the spool 1 to also transport a cut-to-size yarn or thread which must be delivered to the fabric.

While there is shown and described present preferred embodiments of the invention, it is to be distinctly understood that the invention is not limited thereto, but may be otherwise variously embodied and practiced within the scope of the following claims.

Accordingly, what is claimed is:

1. A yarn transport mechanism for a needle band weaving machine, said yarn transport mechanism comprising a pair of spaced rollers, a single endless transport belt entrained over said rollers, said belt having an inner surface engaging said rollers and an outer surface for engagement by yarn to be transported, said belt outer surface having a friction coating for facilitating the gripping or yarn, and drive means for at least one of said rollers, said drive means being of the infinitely variable speed type and being the sole means for driving said belt, said belt at all times having a portion thereof engaging one of said rollers to an extent to substantially reverse the direction of movement of said belt, and said yarn extends substantially entirely around said belt portion with the direction of movement of said yarn being at least substantially reversed, and said belt forming the sole means for driving said yarn.

* * * * *